United States Patent [19]

Nagahiro et al.

[11] Patent Number: 4,741,297

[45] Date of Patent: May 3, 1988

[54] VALVE OPERATING MECHANISM FOR INTERNAL COMBUSTION ENGINE

[75] Inventors: Kenichi Nagahiro; Yoshio Ajiki; Masaaki Katoh, all of Saitama; Kazuo Inoue, Tokyo, all of Japan

[73] Assignee: Honda Giken Kogyo Kabushiki Kaisha, Tokyo, Japan

[21] Appl. No.: 892,181

[22] Filed: Jul. 31, 1986

[30] Foreign Application Priority Data

Jul. 31, 1985 [JP] Japan ..... 60-168713
Jul. 31, 1985 [JP] Japan ..... 60-168712

[51] Int. Cl.[4] ..... F01L 1/34; F01L 1/26
[52] U.S. Cl. ..... 123/90.16; 123/90.44
[58] Field of Search ..... 123/90.16, 90.39, 90.4, 123/90.41, 90.44

[56] References Cited

U.S. PATENT DOCUMENTS 4,523,550 6/1985 Matsuura ..... 123/90.16
4,545,342 10/1985 Nakano et al. ..... 123/90.44 X
4,612,884 9/1986 Ajiki et al. ..... 123/90.16

*Primary Examiner*—Tony M. Argenbright
*Attorney, Agent, or Firm*—Lyon & Lyon

[57] ABSTRACT

A valve operating mechanism for operating at least one valve of an internal combustion engine, includes a camshaft rotatable in synchronism with rotation of the internal combustion engine and having a pair of low- and high-speed cams of different cam profiles, a rocker shaft, and a pair of first and second rocker arms rotatably mounted on the rocker shaft and operable selectively by the low- and high-speed cams for operating the valve according to the cam profiles of the cams. A selective coupling is operatively disposed in and between the first and second rocker arms for interconnecting the first and second rocker arms in high-speed operation of the engine and for disconnecting the first and second rocker arms from each other in low-speed operation of the engine.

12 Claims, 4 Drawing Sheets

VALVE OPERATING MECHANISM FOR INTERNAL COMBUSTION ENGINE

BACKGROUND OF THE INVENTION

The present invention relates to a valve operating mechanism for an internal combustion engine, including a camshaft rotatable in synchronism with the rotation of the internal combustion engine and having integral cams for operating a pair of intake or exhaust valves, and rocker arms angularly movably supported on a rocker shaft for opening and closing the intake or exhaust valves in response to rotation of the cams.

Valve operating mechanisms used in internal combustion engines are generally designed to meet requirements for high-speed operation of the engines. More specifically, the valve diameter and valve lift are selected not to exert substantial resistance to the flow of an air-fuel mixture which is introduced through a valve into a combustion chamber at a rate for maximum engine power.

If an intake valve is actuated at constant valve timing and valve lift throughout a full engine speed range from low to high speeds, then the speed of flow of an air-fuel mixture into the combustion chamber varies from engine speed to engine speed since the amount of air-fuel mixture varies from engine speed to engine speed. At low engine speeds, the speed of flow of the air-fuel mixture is lowered and the air-fuel mixture is subject to less turbulence in the combusion chamber, resulting in slow combustion therein. Therefore, the combustion efficiency is reduced and so is the fuel economy, and the knocking margin is lowered due to the slow combustion.

One solution to the above problems is disclosed in Japanese Laid-Open Patent Publication No. 59(1984)-226216. According to the disclosed arrangement, some of the intake or exhaust valves remain closed when the engine operates at a low speed, whereas all of the intake or exhaust valves are operated, i.e., alternately opened and closed, during high-speed operation of the engine. Therefore, the valves are controlled differently in low-and high-speed ranges.

In the prior valve operating mechanism described above, those intake valves which are not operated in the low-speed range may remain at rest for a long period of time under a certain operating condition. If an intake valve remains at rest for a long time, carbon produced by fuel combustion tends to be deposited between the intake valve and its valve seat, causing the intake valve to stick to the valve seat. When the engine starts to operate in the high-speed range, the intake valve which has been at rest is forcibly separated from the valve seat. This causes the problem of a reduced sealing capability between the intake valve and the valve seat. Furthermore, fuel tends to be accumulated on the intake valve while it is held at rest, with the result that when the intake valve is opened, the air-fuel mixture introduced thereby is excessively enriched by the accumulated fuel.

SUMMARY OF THE INVENTION

It is an object of the present invention to provide a valve operating mechanism for an internal combustion engine, which increases the turbulence of an air-fuel mixture in the combustion chamber during low-speed operation of the engine for improving fuel economy and increasing resistance against a reduction in the density of the air-fuel mixture, and which is designed to solve the problems which would otherwise occur due to an intake valve being continuously closed.

According to the present invention, there is provided a valve operating mechanism for operating at least one valve of an internal combustion engine, comprising a camshaft rotatable in synchronism with rotation of the internal combustion engine and having a pair of low- and high-speed cams of different cam profiles, a rocker shaft, a pair of first and second rocker arms rotatably mounted on the rocker shaft and operable selectively by the low- and high-speed cams for operating the valve according to the cam profiles of the cams, and means operatively disposed in and between the first and second rocker arms for interconnecting the first and second rocker arms in high-speed operation of the engine and for disconnecting the first and second rocker arms from each other in low-speed operation of the engine.

In one preferred embodiment, the first and second rocker arms are held in sliding contact with the low- and high-speed cams, respectively, for operating a pair of valves, respectively.

In another preferred embodiment, the first and second rocker arms are held in sliding contact with the low- and high-speed cams, respectively, the first rocker arm having a pair of arms for operating a pair of valves, respectively.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
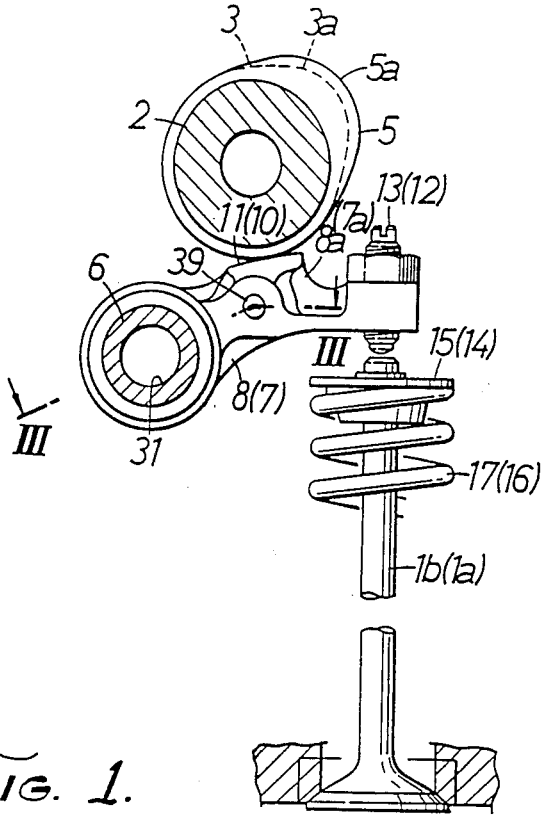
FIG. 1 is a vertical cross-sectional view of a valve operating mechanism according to an embodiment of the present invention, the view being taken along line I—I of FIG. 2.

Like or corresponding parts are denoted by like or corresponding reference characters throughout the views.

Figure 2:
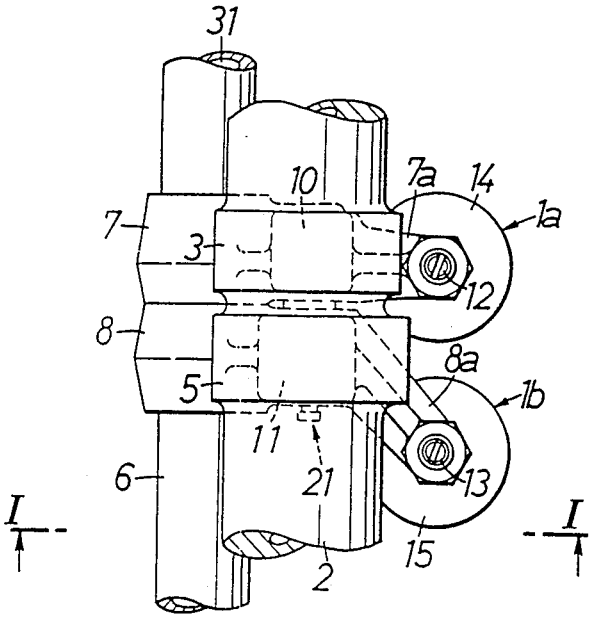
FIG. 2 is a plan view of the valve operating mechanism shown in FIG. 1.

FIGS. 1 and 2 show a valve operating mechanism according to an embodiment of the present invention. The valve operating mechanism is incorporated in an internal combustion engine including a pair of intake valves 1*a*, 1*b* in each engine cylinder for introducing an air-fuel mixture into a combustion chamber defined in an engine body.

The valve operating mechanism comprises a camshaft 2 rotatable in synchronism with rotation of the engine at a speed ratio of ½ with respect to the speed of rotation of the engine crankshaft. The camshaft 2 has a low-speed cam 3 and a high-speed cam 5 which are integrally disposed on the circumference of the camshaft 2. The valve operating mechanism also has a rocker shaft 6 extending parallel to the camshaft 2, and first and second rocker arms 7, 8 angularly movably supported on the rocker shaft 6 and held against the low-speed cam 3 and the high-speed cam 5, respectively, on the camshaft 2. The intake valves 1*a*, 1*b* are selectively operated by the first and second rocker arms 7, 8 actuated by the low- and high-speed cams 4, 5.

The camshaft 2 is rotatably disposed above the engine body. The high-speed cam 5 is disposed in a position corresponding to an intermediate position between the intake valves 1*a*, 1*b*, as viewed in FIG. 2. The low-speed cam 4 is disposed in alignment with the intake valve 1*a*. The low-speed cam 3 has a cam lobe 3*a* projecting radially outwardly to a relatively small extent to meet low-speed operation of the engine, and the high-speed cam 5 has a cam lobe 5*a* projecting radially outwardly a greater extent than the cam lobe 3*a* to meet high-speed operation of the engine, with the cam lobe 5*a* also having a larger angular extent than the cam lobe 3*a*.

The rocker shaft 6 is fixed below the camshaft 2. The first rocker arm 7 pivotally supported on the rocker shaft 6 is aligned with the low-speed cam 3, and the second rocker arm 8 pivotally supported on the rocker arm 6 is aligned with the high-speed cam 5. The rocker arms 7, 8 have on their upper surfaces cam slippers 10, 11 respectively, held in sliding contact with the cams 3, 5, respectively. The first and second rocker arms 7, 8 have arms 7*a*, 8*a* extending above the intake valves 1*a*, 1*b*, respectively. Tappet screws 12, 13 are adjustably threaded through the distal ends of the arms 7*a*, 8*a* and have tips engagable respectively with the upper ends of the valve stems of the intake valves 1*a*, 1*b*.

Flanges 14, 15 are attached to the upper ends of the valve stems of the intake valves 1*a*, 1*b*. The intake valves 1*a*, 1*b* are normally urged to close the intake ports by compression coil springs 16, 17 disposed under compression around the valve stems between the flanges 14, 15 and the engine body.

Figure 4:
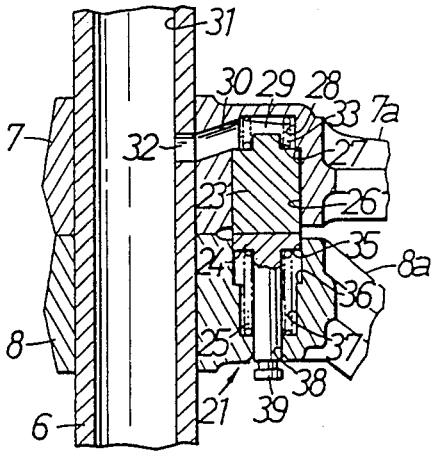
FIG. 4 is a cross-sectional view similar to FIG. 3, showing the first and second rocker arms disconnected from each other.

As shown in FIG. 4, the first and second rocker arms 7, 8 have confronting side walls held in sliding contact with each other. A selective coupling 21 is operatively disposed in and between the first and second rocker arms 7, 8 for selectively disconnecting the rocker arms 7, 8 from each other for relative displacement and also for interconnecting the rocker arms 7, 8 for their movement in unison.

The selective coupling 21 comprises a piston 23 movable between a position in which it interconnects the first and second rocker arms 7, 8 and a position in which it disconnects the first and second rocker arms 7, 8 from each other, a circular stopper 24 for limiting the movement of the piston 23, and a coil spring 25 for urging the stopper 24 to move the piston 23 toward the position to disconnect the first and second rocker arms 7, 8 from each other.

The first rocker arm 7 has a first guide hole 26 opening toward the second rocker arm 8 and extending parallel to the rocker shaft 6. The first rocker arm 7 also has a smaller-diameter hole 28 near the closed end of the first guide hole 26, with a step or shoulder 27 being defined between the smaller-diameter hole 28 and the first guide hole 26. The piston 23 is slidably fitted in the first guide hole 26. The piston 23 and the closed end of the smaller-diameter hole 28 define therebetween a hydraulic pressure chamber 29.

The first rocker arm 7 has a hydraulic passage 30 defined therein in communication with the hydraulic pressure chamber 29. The rocker shaft 6 has a hydraulic passage 31 defined axially therein and coupled to a source (not shown) of hydraulic pressure through a suitable hydraulic pressure control mechanism. The hydraulic passages 30, 31 are held in communication with each other through a hole 32 defined in a side wall of the rocker shaft 6, irrespective of how the first rocker arm 7 is angularly moved about the rocker shaft 6.

The second rocker arm 8 has a second guide hole 35 opening toward the first rocker arm 7 in registration with the first guide hole 26 in the first rocker arm 7. The circular stopper 24 is slidably fitted in the second guide hole 35. The second rocker arm 8 also has a smaller-diameter hole 37 near the closed end of the second guide hole 35, with a step or shoulder 36 defined between the second guide hole 35 and the smaller-diameter hole 37 for limiting movement of the circular stopper 24. The second rocker arm 8 also has a through hole 38-defined coaxially with the smaller-diameter hole 37. A guide rod 39 joined integrally and coaxially to the circular stopper 24 extends through the hole 38. The coil spring 25 is disposed around the guide rod 39 between the stopper 24 and the closed end of the smaller-diameter hole 37.

The piston 23 has an axial length selected such that when one end of the piston 23 abuts against the step 27, the other end thereof is positioned just between and hence lies flush with the sliding side walls of the first and second rocker arms 7, 8, and when the piston 23 is moved into the second guide hole 35 until it displaces the stopper 24 into abutment against the step 36, said one end of the piston 23 remains in the first guide hole 26 and hence the piston 23 extends between the first and second rocker arms 7, 8. The piston 23 is normally urged toward the second rocker arm 8 under the resiliency of a coil spring 33 disposed in the hydraulic pressure chamber 29 and acting between the piston 23 and the closed bottom of the smaller-diameter hole 28. The resilient force of the spring 33 set under compression in the hydraulic pressure chamber 29 is selected to be smaller than that of the spring 25 set in place under compression.

Operation of the valve operating mechanism will be described with reference to FIGS. 3 and 4. When the engine is to operate in a low-speed range, the selective coupling 21 is actuated to disconnect the first and second rocker arm 7, 8 from each other as illustrated in FIG. 4. More specifically, the hydraulic pressure is released by the hydraulic pressure control mechanism from the hydraulic pressure chamber 29, thus allowing the stopper 24 to move toward the first rocker arm 7 under the resiliency of the spring 25 until the piston 23 abuts against the step 27. When the piston 23 engages the step 27, the mutually contacting ends of the piston 23 and the stopper 24 lie flush with the sliding side walls of the first and second rocker arms 7, 8. Therefore, the first and second rocker arms 7, 8 are held in mutually sliding contact for relative angular movement.

With the first and second rocker arms 7, 8 being thus disconnected, the first rocker arm 7 is angularly moved in sliding contact with the low-speed cam 3, whereas the second rocker arm 8 is angularly moved in sliding contact with the high-speed cam 5. Therefore, the intake valve 1*a* alternately opens and closes the intake port at the valve timing and valve lift according to the profile of the low-speed cam 3, and the intake valve 1*b* alternately opens and closes the intake port at the valve timing and valve lift according to the profile of the high-speed cam 5.

Since the intake valves 1*a*, 1*b* are operated at different valve timings and lifts, the turbulence of the air-fuel mixture in the combustion chamber is increased for greater resistance against a reduction in the density of the air-fuel mixture. This also helps improve fuel economy.

Figure 3:
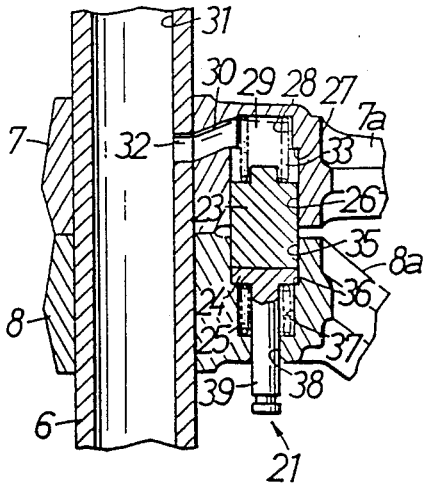
FIG. 3 is a cross-sectional view taken along line III—III of FIG. 1, first and second rocker arms interconnected.

For high-speed operation of the engine, the first and second rocker arms 7, 8 are interconnected by the selective coupling 21, as shown in FIG. 3. More specifically, the hydraulic pressure chamber 29 of the selective coupling 21 is supplied with hydraulic pressure to cause the piston 23 to push the stopper 24 into the second guide hole 35 against the resiliency of the spring 25 until the stopper 24 engages the step 36. The first and second rocker arms 7, 8 are now connected to each other for angular movement in unison.

Inasmuch as the second rocker arm 8 held in sliding contact with the high-speed cam 5 swings to a greater extent than the first rocker arm 7, the first rocker arm 7 is caused to swing with the second rocker arm 8. Therefore, the intake valves 1*a*, 1*b* alternately open and close the respective intake ports at the valve timing and valve lift according to the profile of the high-speed cam 5. The intake efficiency is now increased for higher engine output power and torque.

In the low- and high-speed ranges of engine operation, the intake valves 1*a*, 1*b* are operated at all times. Therefore, no carbon will be deposited between the intake valves 1*a*, 1*b* and their valve seats, and no fuel will be accumulated on the intake valves 1*a*, 1*b*.

Figure 5:
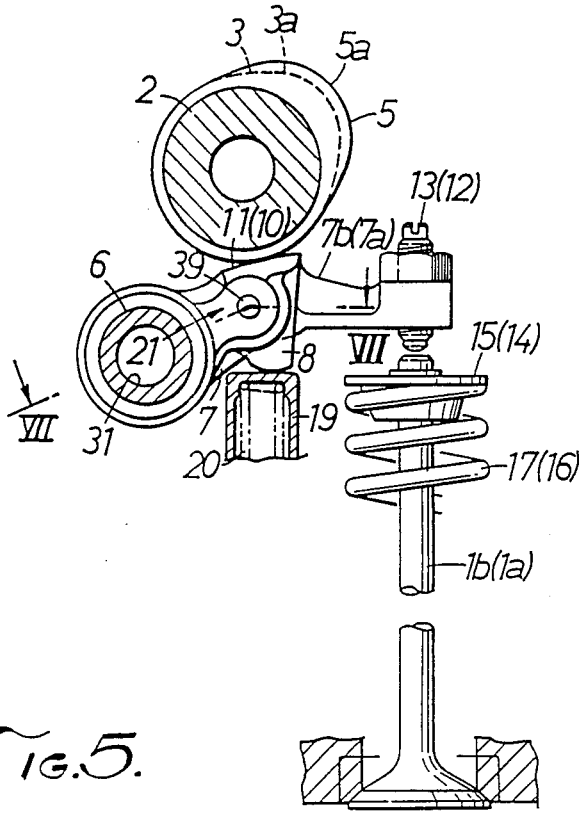
FIG. 5 is a vertical cross-sectional view of a valve operating mechanism according to another embodiment of the present invention, the view being taken along line V—V of FIG. 6.
Figure 6:
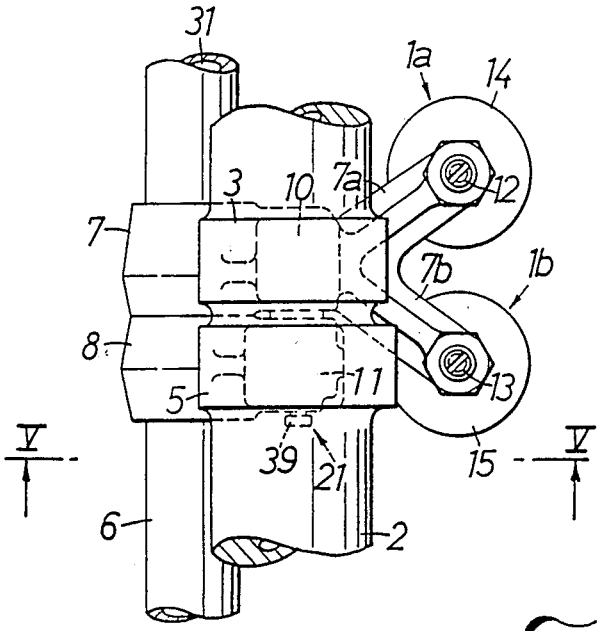
FIG. 6 is a plan view of the valve operating mechanism shown in FIG. 5.

FIGS. 5 and 6 are illustrative of a valve operating mechanism according to another embodiment of the present invention. The valve operating mechanism shown in FIGS. 5 and 6 differs from the valve operating mechanism of FIGS. 1 and 2 in that the first rocker arm 7 has a pair of arms 7*a*, 7*b* jointly shaped in a V, and the tappet screws 12, 13 are adjustably threaded through the distal ends of the arms 7*a*, 7*b* for engagement with the upper ends of the valve stems of the intake valves 1*a*, 1*b*. The second rocker arm 8 has no arm for directly acting on the intake valves 1*a*, 1*b*. As shown in FIG. 5, a bottomed cylindrical lifter 19 is disposed in abutment against a lower surface of the second rocker arm 8. The lifter 19 is normally urged upwardly by a compression spring 20 of relatively weak resiliency interposed between the lifter 19 and the engine body for resiliently biasing the cam slipper 11 of the second rocker arm 8 slidably against the high-speed cam 5.

Figure 7:
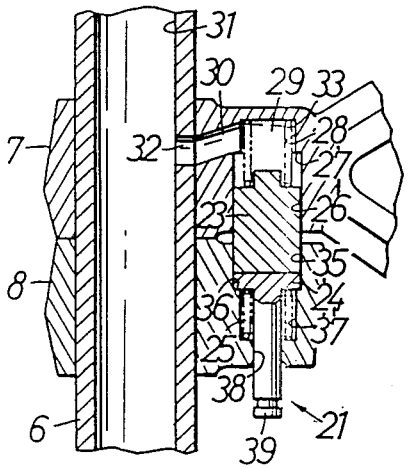
FIG. 7 is a cross-sectional view taken along line VII—VII of FIG. 5, showing the first and second rocker arms interconnected.

The valve operating mechanism shown in FIGS. 5 and 6 has a selective coupling 21 which, as shown in FIG. 7, is structurally identical to the selective coupling 21 shown in FIG. 3.

Figure 8:
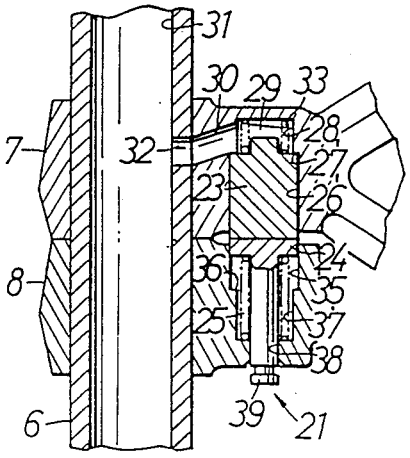
FIG. 8 is a cross-sectional view similar to FIG. 7, showing the first and second rocker arms disconnected from each other.

Operation of the valve operating mechanism of FIGS. 5 and 6 will be described with reference to FIGS. 7 and 8. When the engine is to operate in a low-speed range, the selective coupling 21 is actuated to disconnect the first and second rocker arm 7, 8 from each other as illustrated in FIG. 8. The first and second rocker arms 7, 8 are now held in mutually sliding contact for relative angular movement With the first and second rocker arms 7, 8 being thus disconnected, the first rocker arm 7 is angularly moved in sliding contact with the low-speed cam 3, whereas the second rocker arm 8 is angularly moved in sliding contact with the high-speed cam 5. Therefore, the intake valves 1*a*, 1*b* are actuated by the respective arms 7*a*, 7*b* of the first rocker arm 7 to alternately open and close the respective intake ports at the valve timing and valve lift according to the profile of the low-speed cam 3. Since the second rocker arm 8 is disconnected from the first rocker arm 7, the angular movement of the second rocker arm 8 does not affect operation of the intake valves 1*a*, 1*b*. Any frictional loss of the valve operating mechainsm is relatively low because the second rocker arm 8 is held in sliding contact with the high-speed cam 5 under the relatively small resilient force of the spring 20.

During low-speed operation of the engine, therefore, the intake valves 1*a*, 1*b* alternately open and close the respective intake ports at the valve timing and valve lift according to the profile of the low-speed cam 3. Accordingly, the air-fuel mixture flows into the combustion chamber at a rate suitable for the low-speed operation of the engine, resulting in improved fuel economy and prevention of knocking.

For high-speed operation of the engine, the first and second rocker arms 7, 8 are interconnected by the selective coupling 21, as shown in FIG. 7. The first rocker arm 7 is now caused to swing in unison with the second rocker arm 8 which is held in sliding contact with the high-speed cam 5.

The intake valves 1*a*, 1*b* are operated by the arms 7*a*, 7*b* of the first rocker arm 7 to alternately open and close the respective intake ports at the valve timing and valve lift according to the profile of the high-speed cam 5. The intake efficiency is now increased for higher engine output power and torque.

Figure 9:
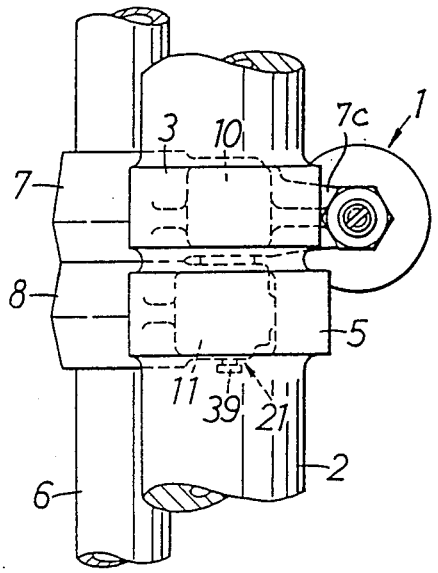
FIG. 9 is a plan view of a valve operating mechanism according to still another embodiment of the present invention.

FIG. 9 shows a valve operating mechanism according to still another embodiment of the present invention. The valve operating mechanism of FIG. 9 is essentially the same as those shown in FIGS. 1 and 5 except that it operates only one intake valve 1 per engine cylinder. The first rocker arm 7 has an arm 7*c* for operating the intake valve 1.

While the intake valves 1*a*, 1*b* are shown as being operated by each of the valve operating mechanisms, exhaust valves may also be operated by the valve operating mechanisms according to the present invention. In such a case, unburned components due to exhaust gas turbulence can be reduced in low-speed operation of the engine, whereas high engine output power and torque can be generated by reducing resistance to the flow of an exhaust gas from the combustion chamber in high-speed operation of the engine.

Although certain preferred embodiments have been shown and described, it should be understood that many changes and modifications may be made therein without departing from the scope of the appended claims.

We claim:

1. A valve operating mechanism for operating at least one valve of an internal combustion engine, comprising:

a camshaft rotatable in synchronism with rotation of the internal combustion engine and having a pair of low- and high-speed cams of different cam profiles;

a rocker shaft;

a pair of first and second rocker arms mounted for pivotal movement on said rocker shaft, each of said rocker arms being held in sliding contact with one of said cams and being operable selectively by said low- and high-speed cams for operating the valve according to the cam profiles of said cams; and means operatively disposed in and between said first and second rocker arms for interconnecting said first and second rocker arms in high-speed operation of the engine and for disconnecting said first and second rocker arms from each other in low-speed operation of the engine.

2. A valve operating mechanism according to claim 1, wherein said first and second rocker arms operate a pair of valves, respectively.

3. A valve operating mechanism according to claim 1, wherein said first rocker arm has a pair of arms for operating a pair of valves.

4. A valve operating mechanism according to claim 3, including lifter means for normally urging said second rocker arm resiliently into sliding contact with said highspeed cam.

5. A valve operating mechanism according to claim 1, wherein said first rocker arms has an arm for operating a single valve.

6. A valve operating mechanism according to claim 1, wherein said means comprises a selective coupling composed of a first guide hole defined in said first rocker arm, a second guide hole defined in said second rocker arm in registration with said first guide hole, a piston slidably fitted in said first guide hole, a spring disposed in said second guide hole for normally urging said piston into said first guide hole, and means for applying hydraulic pressure to said piston to move the same to a position between said first and second guide holes against the resiliency of said spring.

7. A valve operating mechanism for operating valve means of an internal combustion engine, comprising:

a camshaft rotatable in synchronism with rotation of said engine;

a plurality of rocker arms disposed in side-by-side relation and operatively connecting said valve means to open and close said valve means in accordance with a desired mode of operation;

a plurality of cams mounted for rotation on said camshaft, each said cam engaging one of said rocker arms and each having a cam profile effective to impart a selected mode of operation to said valve means;

hydraulically operated means carried by said rocker arms for interconnecting and disconnecting said rocker arms; and means for selectively actuating said coupling means.

8. A valve operating mechanism according to claim 7 in which said coupling means comprises a guide hole disposed in each of said rocker arms for registration therebetween; a movable piston in each said guide hole, said pistons having end surfaces normally aligned with the sides of said rocker arms for relative pivotal movement therebetween; said actuating means being operative to move said pistons for interconnecting said rocker arms for pivotal movement in unison.

9. A valve operating mechanism according to claim 8 in which said actuating means comprise a spring engaging one of said pistons operative to normally bias said pistons to disconnect said rocker arms; and selectively operated hydraulic means communicating with the other said piston operative to move said pistons against the bias of said spring to interconnect said rocker arms.

10. A valve operating mechanism according to claim 9 in which said valve comprises a pair of valves, one of said valves being operatively connected to each of said rocker arms.

11. A valve operating mechanism according to claim 9 in which said valve means comprises a pair of valves operatively connecting one of said rocker arms; and lifter means for normally urging the other said rocker arm resiliently into sliding engagement with its associated cam.

12. A valve operating mechanism according to claim 9 in which said valve means comprises a single valve operatively connecting one of said rocker arms; and lifter means for normally urging the other said rocker arm resiliently into sliding engagement with its associated cam.

* * * * *